US011095032B2

(12) United States Patent
Tseng et al.

(10) Patent No.: US 11,095,032 B2
(45) Date of Patent: Aug. 17, 2021

(54) ANTENNA STRUCTURE

(71) Applicant: Quanta Computer Inc., Taoyuan (TW)

(72) Inventors: Yi-Ling Tseng, Taoyuan (TW); Chung-Hung Lo, Taoyuan (TW); Chin-Lung Tsai, Taoyuan (TW); Kuan-Hsien Lee, Taoyuan (TW); Ying-Cong Deng, Taoyuan (TW); Chung-Ting Hung, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 40 days.

(21) Appl. No.: 16/747,222

(22) Filed: Jan. 20, 2020

(65) Prior Publication Data

US 2021/0167499 A1 Jun. 3, 2021

(30) Foreign Application Priority Data

Nov. 28, 2019 (TW) ..... 108143307

(51) Int. Cl.
*H01Q 5/30* (2015.01)
*H01Q 5/307* (2015.01)
*H01Q 1/48* (2006.01)

(52) U.S. Cl.
CPC ..... *H01Q 5/307* (2015.01); *H01Q 1/48* (2013.01)

(58) Field of Classification Search
CPC .. H01Q 1/22; H01Q 1/243; H01Q 1/38–1/48; H01Q 5/30–5/385; H01Q 13/10
See application file for complete search history.

(56) References Cited

U.S. PATENT DOCUMENTS

| | | | | |
|---|---|---|---|---|
| 10,873,124 | B2 * | 12/2020 | Chen | H01Q 5/378 |
| 10,910,698 | B2 * | 2/2021 | Wei | H01Q 1/244 |
| 2014/0176378 | A1 | 6/2014 | Yu et al. | |
| 2019/0221943 | A1 * | 7/2019 | Wu | H01Q 13/106 |

FOREIGN PATENT DOCUMENTS

| | | | |
|---|---|---|---|
| TW | 201427181 | A | 7/2014 |
| WO | 2019/086866 | A1 | 5/2019 |

OTHER PUBLICATIONS

Chinese language office action dated Jun. 19, 2020, issued in application No. TW 108143307.

* cited by examiner

*Primary Examiner* — Hasan Islam
(74) *Attorney, Agent, or Firm* — McClure, Qualey & Rodack, LLP

(57) ABSTRACT

An antenna structure includes a ground plane, a first radiation element, a second radiation element, a third radiation element, and a fourth radiation element. A closed slot is formed in the ground plane. The first radiation element has a feeding point. The first radiation element is coupled to a first shorting point on the ground plane. The second radiation element is coupled to a second shorting point on the ground plane. The second radiation element is adjacent to the first radiation element. The third radiation element is coupled to the feeding point. The fourth radiation element is coupled to a third shorting point on the ground plane. The fourth radiation element is adjacent to the third radiation element. The first radiation element, the second radiation element, the third radiation element, and the fourth radiation element are all disposed inside the closed slot.

10 Claims, 2 Drawing Sheets

ANTENNA STRUCTURE

CROSS REFERENCE TO RELATED APPLICATIONS

This application claims priority of Taiwan Patent Application No. 108143307 filed on Nov. 28, 2019, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

In an exemplary embodiment, the disclosure is directed to an antenna structure which includes a ground plane, a first radiation element, a second radiation element, a third radiation element, and a fourth radiation element. A closed slot is formed in the ground plane. The first radiation element has a feeding point. The first radiation element is coupled to a first shorting point on the ground plane. The second radiation element is coupled to a second shorting point on the ground plane. The second radiation element is adjacent to the first radiation element. The third radiation element is coupled to the feeding point. The fourth radiation element is coupled to a third shorting point on the ground plane. The fourth radiation element is adjacent to the third radiation element. The first radiation element, the second radiation element, the third radiation element, and the fourth radiation element are all disposed inside the closed slot.

In some embodiments, the first radiation element substantially has a U-shape.

In some embodiments, the second radiation element substantially has an L-shape.

In some embodiments, the closed slot has a first edge and a second edge which are opposite to each other. The first shorting point is positioned at the first edge of the closed slot. The second shorting point and the third shorting point are both positioned at the second edge of the closed slot.

In some embodiments, the antenna structure covers a first frequency band and a second frequency band. The first frequency band is from 2400 MHz to 2500 MHz. The second frequency band is from 5150 MHz to 5850 MHz.

In some embodiments, the length of the closed slot is from 0.25 to 0.5 wavelength of the first frequency band.

In some embodiments, a first coupling gap is formed between the first radiation element and the second radiation element, such that the second radiation element is excited by the first radiation element using a coupling mechanism.

In some embodiments, the length of each of the first radiation element and the second radiation element is shorter than or equal to 0.25 wavelength of the first frequency band.

In some embodiments, a second coupling gap is formed between the third radiation element and the fourth radiation element, such that the fourth radiation element is excited by the third radiation element using a coupling mechanism.

In some embodiments, the length of each of the third radiation element and the fourth radiation element is shorter than or equal to 0.25 wavelength of the second frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
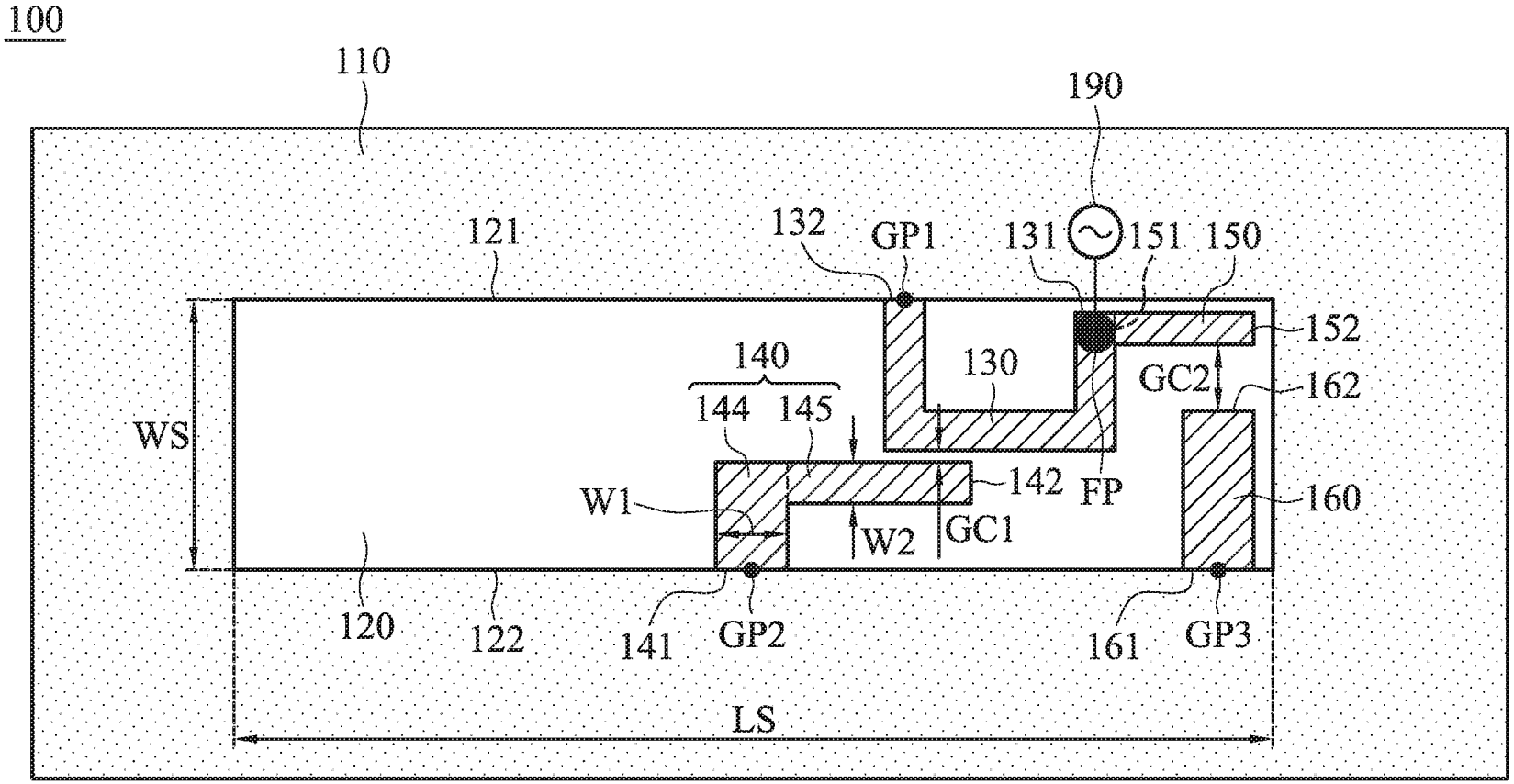
FIG. 1 is a top view of an antenna structure according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a top view of an antenna structure 100 according to an embodiment of the invention. The antenna structure 100 may be applied to a mobile device, such as a wireless loudspeaker, a smart phone, a tablet computer, or a notebook computer. As shown in FIG. 1, the antenna structure 100 at least includes a ground plane 110, a first radiation element 130, a second radiation element 140, a third radiation element 150, and a fourth radiation element 160. The antenna structure 100 may be planar and disposed on a dielectric substrate (not shown), such as an FR4 (Flame Retardant 4) substrate, a PCB (Printed Circuit Board), or an FCB (Flexible Circuit Board). The ground plane 110, the first radiation element 130, the second radiation element 140, the third radiation element 150, and the fourth radiation element 160 may all be made of metal materials, such as silver, copper, aluminum, iron, or their alloys.

The ground plane 110 may substantially have a relatively large rectangular shape. A closed slot 120 is formed in the ground plane 110. The closed slot 120 may substantially have a relatively small rectangular shape. Specifically, the closed slot 120 has a first edge 121 and a second edge 122 which are opposite to each other. The first radiation element 130, the second radiation element 140, the third radiation element 150, and the fourth radiation element 160 are all disposed inside the closed slot 120 and are between the first edge 121 and the second edge 122.

The first radiation element 130 may substantially have a U-shape. Specifically, the first radiation element 130 has a first end 131 and a second end 132. A feeding point FP is positioned at the first end 131 of the first radiation element 130. The second end 132 of the first radiation element 130 is coupled to a first shorting point GP1 on the ground plane 110. The first shorting point GP1 is positioned at the first edge 121 of the closed slot 120. The feeding point FP may be further coupled to a signal source 190, such as an RF (Radio Frequency) module, for exciting the antenna structure 100.

The second radiation element 140 may substantially have an L-shape. Specifically, the second radiation element 140 has a first end 141 and a second end 142. The first end 141 of the second radiation element 140 is coupled to a second shorting point GP2 of the ground plane 110. The second end 142 of the second radiation element 140 is an open end, which is adjacent to the first radiation element 130. The second shorting point GP2 is positioned at the second edge 122 of the closed slot 120. It should be noted that the term "adjacent" or "close" over the disclosure means that the distance (spacing) between two corresponding elements is smaller than a predetermined distance (e.g., 5 mm or shorter), but does not mean that the two corresponding elements are touching each other directly (i.e., the aforementioned distance/spacing therebetween is reduced to 0). In some embodiments, the second radiation element 140 has a variable-width structure and includes a wide portion 144 and a narrow portion 145. The wide portion 144 is adjacent to the first end 141 of the second radiation element 140. The narrow portion 145 is adjacent to the second end 142 of the second radiation element 140. However, the invention is not limited thereto. In alternative embodiments, adjustments are made such that the second radiation element 140 has an equal-width structure.

The third radiation element 150 may substantially have a straight-line shape. Specifically, the third radiation element 150 has a first end 151 and a second end 152. The first end 151 of the third radiation element 150 is coupled to the feeding point FP. The second end 152 of the third radiation element 150 is an open end, which extends away from the first radiation element 130. Furthermore, the second end 152 of the third radiation element 150 and the second end 142 of the second radiation element 140 may substantially extend in the same direction. That is, the narrow portion 145 of the second radiation element 140 and the third radiation element 150 may both be substantially parallel to the first edge 121 and the second edge 122 of the closed slot 120.

The fourth radiation element 160 may substantially have a straight-line shape, which may be substantially perpendicular to the third radiation element 150. Specifically, the fourth radiation element 160 has a first end 161 and a second end 162. The first end 161 of the fourth radiation element 160 is coupled to a third shorting point GP3 on the ground plane 110. The second end 162 of the fourth radiation element 160 is an open end, which is adjacent to the third radiation element 150. The third shorting point GP3 is positioned at the second end 122 of the closed slot 120. The position of the third shorting point GP3 may be different from the position of the second shorting point GP2.

Figure 2:
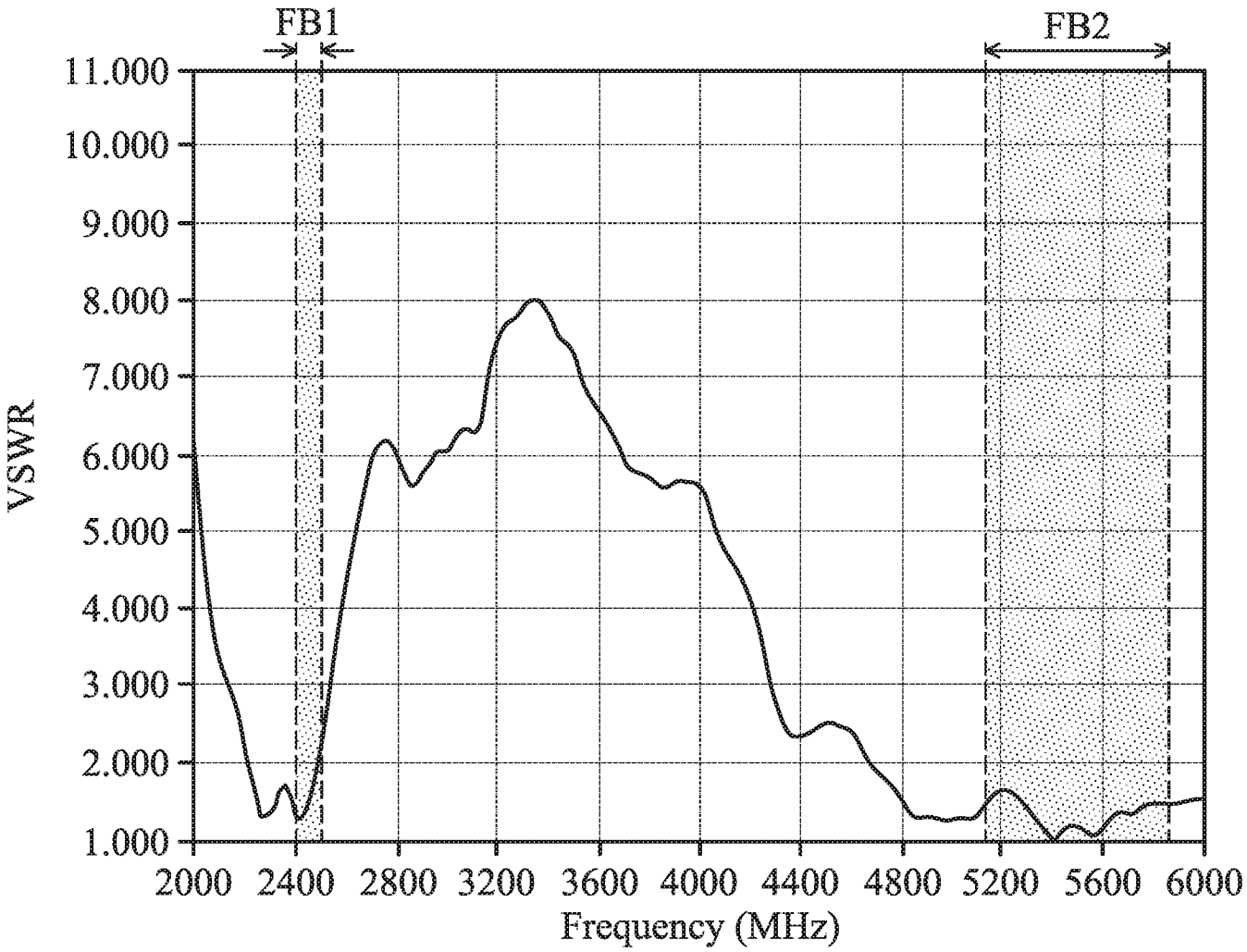
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 2, the antenna structure 100 can cover a first frequency band FB1 and a second frequency band FB2. For example, the first frequency band FB1 may be from 2400 MHz to 2500 MHz, and the second frequency band FB2 may be from 5150 MHz to 5850 MHz. Accordingly, the antenna structure 100 can support at least the dual-band operations of WLAN (Wireless Local Area Networks) 2.4 GHz/5 GHz.

In some embodiments, the operation principles of the antenna structure 100 are described as follows. A first coupling gap GC1 is formed between the first radiation element 130 and the second radiation element 140, and therefore the second radiation element 140 is excited by the first radiation element 130 using a coupling mechanism, so as to generate the first frequency band FB1. A second coupling gap GC2 is formed between the third radiation element 150 and the fourth radiation element 160, and therefore the fourth radiation element 160 is excited by the third radiation element 150 using a coupling mechanism, so as to generate the second frequency band FB2. Generally, the second radiation element 140 is configured to fine-tune the impedance matching of the first frequency band FB1 and to increase the operation bandwidth of the first frequency band FB1. The fourth radiation element 160 is configured to fine-tune the impedance matching of the second frequency band FB2 and to increase the operation bandwidth of the second frequency band FB2.

In some embodiments, the element sizes of the antenna structure 100 are described as follows. The length LS of the closed slot 120 may be from 0.25 to 0.5 wavelength of the first frequency band FB1 ($\lambda/4$~$\lambda/2$). The width WS of the closed slot 120 may be from 6 mm to 10 mm. The length of the first radiation element 130 (i.e., the length from the first end 131 to the second end 132) may be shorter than or equal to 0.25 wavelength of the first frequency band FB1 ($\lambda/4$). The length of the second radiation element 140 (i.e., the length from the first end 141 to the second end 142) may be shorter than or equal to 0.25 wavelength of the first frequency band FB1 (λ/4). Among the second radiation element 140, the width W1 of the wide portion 144 may be 1.5 to 2 times the width W2 of the narrow portion 145. The length of the third radiation element 150 (i.e., the length from the first end 151 to the second end 152) may be shorter than or equal to 0.25 wavelength of the second frequency band FB2 (λ/4). The length of the fourth radiation element 160 (i.e., the length from the first end 161 to the second end 162) may be shorter than or equal to 0.25 wavelength of the second frequency band FB2 (λ/4). The width of the first coupling gap GC1 may be from 0.2 mm to 1 mm. The width of the second coupling gap GC2 may be from 0.2 mm to 5 mm. The above ranges of element sizes are calculated and obtained according to many experiment results, and they help to optimize the operation bandwidth and impedance matching of the antenna structure 100.

The invention proposes a novel antenna structure, which is integrated with a slot of a ground plane, so as to minimize the total antenna size. Generally, the invention has at least the advantages of small size, wide bandwidth, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-2. The invention may merely include any one or more features of any one or more embodiments of FIGS. 1-2. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground plane, wherein a closed slot is formed in the ground plane;

a first radiation element, having a feeding point, and coupled to a first shorting point on the ground plane;

a second radiation element, coupled to a second shorting point on the ground plane, wherein the second radiation element is adjacent to the first radiation element;

a third radiation element, coupled to the feeding point; and a fourth radiation element, coupled to a third shorting point on the ground plane, wherein the fourth radiation element is adjacent to the third radiation element;

wherein the first radiation element, the second radiation element, the third radiation element, and the fourth radiation element are all disposed inside the closed slot.

2. The antenna structure as claimed in claim 1, wherein the first radiation element substantially has a U-shape.

3. The antenna structure as claimed in claim 1, wherein the second radiation element substantially has an L-shape.

4. The antenna structure as claimed in claim 1, wherein the closed slot has a first edge and a second edge opposite to each other, the first shorting point is positioned at the first edge of the closed slot, and the second shorting point and the third shorting point are positioned at the second edge of the closed slot.

5. The antenna structure as claimed in claim 1, wherein the antenna structure covers a first frequency band and a second frequency band, the first frequency band is from 2400 MHz to 2500 MHz, and the second frequency band is from 5150 MHz to 5850 MHz.

6. The antenna structure as claimed in claim 5, wherein a length of the closed slot is from 0.25 to 0.5 wavelength of the first frequency band.

7. The antenna structure as claimed in claim 5, wherein a first coupling gap is formed between the first radiation element and the second radiation element, such that the second radiation element is excited by the first radiation element using a coupling mechanism.

8. The antenna structure as claimed in claim 5, wherein a length of each of the first radiation element and the second radiation element is shorter than or equal to 0.25 wavelength of the first frequency band.

9. The antenna structure as claimed in claim 5, wherein a second coupling gap is formed between the third radiation element and the fourth radiation element, such that the fourth radiation element is excited by the third radiation element using a coupling mechanism.

10. The antenna structure as claimed in claim 5, wherein a length of each of the third radiation element and the fourth radiation element is shorter than or equal to 0.25 wavelength of the second frequency band.

* * * * *